US009157284B2

(12) United States Patent
Barnes et al.

(10) Patent No.: US 9,157,284 B2
(45) Date of Patent: Oct. 13, 2015

(54) DOWNHOLE MOTOR BEARING ASSEMBLY WITH AN INTEGRATED THRUST SHOCK ABSORBER FOR DOWNHOLE DRILLING AND METHOD THEREOF

(76) Inventors: Matthew J. Barnes, The Woodlands, TX (US); Aaron T. Kirk, Montgomery, TX (US); Christopher J. Rayha, Willis, TX (US)

( * ) Notice: Subject to any disclaimer, the term of this patent is extended or adjusted under 35 U.S.C. 154(b) by 877 days.

(21) Appl. No.: 13/142,771

(22) PCT Filed: Aug. 17, 2010

(86) PCT No.: PCT/US2010/045764

§ 371 (c)(1), (2), (4) Date: Apr. 30, 2012

(87) PCT Pub. No.: WO2011/022403

PCT Pub. Date: Feb. 24, 2011

(65) Prior Publication Data

US 2012/0205158 A1 Aug. 16, 2012

Related U.S. Application Data

(60) Provisional application No. 61/234,438, filed on Aug. 17, 2009.

(51) Int. Cl.
*E21B 17/07* (2006.01)

(52) U.S. Cl.
CPC ..... *E21B 17/076* (2013.01)

(58) Field of Classification Search
CPC ..... E21B 17/07; E21B 23/004; E21B 17/076
See application file for complete search history.

(56) References Cited

U.S. PATENT DOCUMENTS

| | | | | |
|---|---|---|---|---|
| 3,879,094 | A * | 4/1975 | Tschirky et al. | 384/420 |
| 4,186,569 | A | 2/1980 | Aumann | |
| 4,194,582 | A * | 3/1980 | Ostertag | 175/321 |
| 4,232,751 | A | 11/1980 | Trzeciak | |
| 4,466,496 | A | 8/1984 | Jones | |
| 2004/0140131 | A1 * | 7/2004 | Susman | 175/296 |

OTHER PUBLICATIONS

International Search Report for International Application No. PCT/US2010/045764, mailed on Apr. 13, 2011 (3 pages).
Informal Comments in Response to the International Search Report and Written Opinion filed on Jun. 10, 2011, for International Application No. PCT/US2010/045764 (9 pages).

* cited by examiner

*Primary Examiner* — Catherine Loikith

(57) ABSTRACT

A shock absorber for attachment between a downhole motor and drill bit for drilling a well. Shafts within the tool's housing are supported by radial bearings outside of the shafts, and slideably and rotationally engaged with each other by mating splines. The lower shaft telescopically extends from around the outside of the upper shaft, the extension limited by an upper shaft mandrel ledge against a lower shaft internal shoulder. A biasing mechanism within the shock absorber's housing dampens shock between the motor and bit.

21 Claims, 3 Drawing Sheets

DOWNHOLE MOTOR BEARING ASSEMBLY WITH AN INTEGRATED THRUST SHOCK ABSORBER FOR DOWNHOLE DRILLING AND METHOD THEREOF

CROSS REFERENCE TO RELATED APPLICATION

This application claims priority to provisional patent application 61/234,438 entitled "Downhole Motor Bearing Assembly with an Integrated Thrust Shock Absorber for Downhole Drilling and Method Thereof" filed on Aug. 17, 2009, which is hereby incorporated by reference in its entirety.

BACKGROUND

The present disclosure generally relates to radial bearing systems and more particularly, to shock absorbers for radial bearing systems in downhole drilling assemblies.

In the drilling of wells for exploration and/or production of hydrocarbons, downhole drilling assemblies are often operably disposed near a drill bit in a sub-surface formation to rotate a drill bit rather than rotating an entire drill string. In such drilling operations, the drill string includes joined lengths of pipe that extend down into a wellbore.

These types of drilling assemblies usually contain a fluid-driven motor that is typically attached to the bottom end of the drill string. For example, a "Moineau" or progressive-cavity type motor may be operated by the flow of drilling fluids pumped down through the drill string from the surface. The motor drives an output shaft which is in turn coupled to a drill bit to rotate the drill bit.

Drilling fluid or mud is pumped down the drill string to the drilling assembly to drive the fluid motor. The mud is pumped into a casing at a predetermined pressure. The pressurized mud rotates the output shaft and correspondingly, the drill bit. The drilling mud leaving the motor is directed through the shaft to the bit and through well bore to cool the bit and remove rock fragments from the well.

Various components of the drill string are subjected to axial vibrations, thrust loads, and shocks during drilling operations. These typically high dynamic stresses and/or vibrations on the drill string may be substantial, particularly during drilling operations in hard and/or non-homogeneous formations. It is desirable to minimize the transmission of such vibrations to reduce the exposure of the components of the drill string to thrust loads. Specifically, it is desirable to dampen axial vibrations and shocks to components such as instrumentation that may be disposed along or within the drill string. Further, dampening axial shock is helpful in reducing bit bounce (i.e., the inability of a drill bit to maintain engagement/contact with the formation) thereby, increasing the rate of penetration of the drill bit and increasing the overall efficiency of the drilling effort.

Conventional approaches to dampen or otherwise absorb axial vibrations and shocks during drilling suffer from a number of disadvantages. Specifically, some conventional shock subs do not function optimally because the shock subs are typically disposed upstream of the bit at a distance that is too far from the drill bit to most effectively dampen axial vibrations.

In addition, conventional shock subs are typically incapable of fully reducing bit bounce. Excessive bit bounce typically results in reduced efficiency and shortens the lifespan of the drill bit. In addition, conventional shock subs may transmit excessive vibration along the drill string, damaging sensitive electronic components and other components of the drill string. Furthermore, conventional shock subs are sensitive to hydraulic flow through the downhole assembly. Specifically, hydraulic flow through the assembly significantly impedes the dampening characteristics of the shock sub. Still further, fluid flow through the shock sub significantly influences the telescopic extension of the shock sub. These effects limit the operating range of the shock sub and restrict the ability of the shock sub to function properly under certain conditions. In summary, these complexities adversely complicate the design and operation of the conventional shock sub.

Another disadvantage of some conventional shock sub designs is the excessive additional length that is introduced in the downhole assembly when a motor is attached to the drill string. This additional length may be particularly undesirable in instances where it is desirable to minimize the distance between the drill bit and the shock sub. As would be understood by those of ordinary skill in the art, it is desirable to locate the shock sub as close to the drill bit as possible to achieve maximum efficiency.

Accordingly, an improved shock sub design is needed to address the above-identified disadvantages of the prior art.

SUMMARY

In one embodiment, a downhole assembly includes a motor operatively coupled to a transmission, wherein the transmission is operatively coupled to an upper shaft disposed within a housing. The upper shaft is supported by a first radial bearing assembly disposed within the housing. A thrust bearing assembly including a ball bearing disposed between two races is provided. The upper shaft extends through and is supported by the first radial bearing. A distal end of the upper shaft has a first set of mating splines disposed thereon. A lower shaft supported by a second radial bearing assembly is disposed within the housing, wherein the lower shaft has a second set of mating splines disposed thereon. The second set of mating splines are adapted to mate with the first set of mating splines and the lower shaft is in coaxial relationship and telescopically extendable from the upper shaft. A catch is machined on an internal surface of the lower shaft to limit the extent of travel of the lower shaft. A biasing mechanism is disposed adjacent the ball bearing, wherein the biasing mechanism biases the lower shaft in an extended position with respect to the upper shaft, wherein the biasing mechanism comprises a series of disc springs. A drill bit that is operatively coupled to the lower shaft.

In another embodiment a shock absorber assembly includes a housing and a biasing mechanism disposed within the housing. A rotatable shaft assembly includes an upper shaft that is supported by a first radial bearing. A lower shaft is supported by a second radial bearing and is concentrically disposed around at least a portion of the upper shaft. The lower shaft is telescopically extendable from the upper shaft. A drill bit is coupled to a the lower shaft.

In yet another embodiment, a method of dampening axial shock on a drill bit includes the steps of providing a housing, wherein a biasing mechanism is disposed within the housing. The method further includes a step of providing a rotatable shaft assembly that includes an upper shaft supported by a first radial bearing and a lower shaft supported by a second radial bearing. The lower shaft is concentrically disposed around at least a portion of the upper shaft and the lower shaft is telescopically extendable from the upper shaft. Still further, the method comprises the steps of providing a thrust bearing assembly disposed adjacent the biasing mechanism and providing a drill bit that is coupled to a the lower shaft.

The features and advantages of the present disclosure will be apparent to those skilled in the art. While numerous changes may be made by those skilled in the art, such changes are within the spirit of the invention.

BRIEF DESCRIPTION OF THE DRAWINGS

A more complete understanding of the present disclosure and advantages thereof may be acquired by referring to the following description taken in conjunction with the accompanying figures, wherein.

Figure 1:
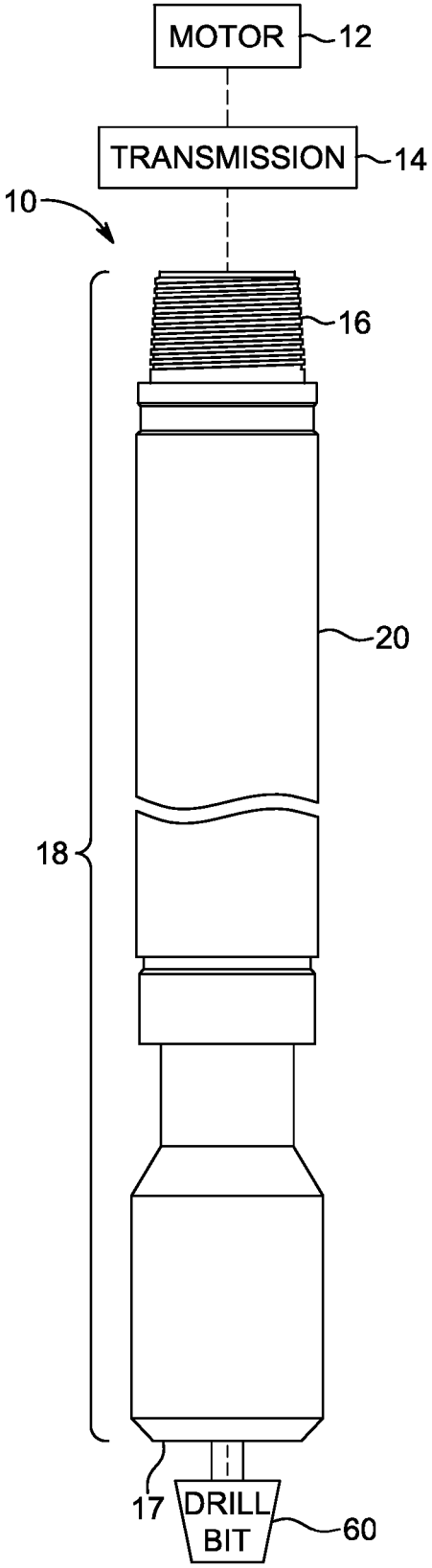
FIG. 1 depicts a front elevational view of a drilling assembly.

While the present disclosure is susceptible to various modifications and alternative forms, specific exemplary embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DESCRIPTION OF PREFERRED EMBODIMENTS

Radial bearing assemblies disclosed herein stabilize and support rotating shafts in downhole drilling assemblies. In certain embodiments, the radial bearing assemblies of the present disclosure produce less friction compared to conventional bearing assemblies. Less friction is desirable because less heat is generated by rotating components that experience less friction, and thereby results in higher efficiencies of power output. Further, reduced friction and the resulting lower heat generation is desirable to reduce wear and tear on the bearing assembly components. Accordingly, certain embodiments of the radial bearing assemblies disclosed herein experience longer life spans due to reduced wear and tear. Consequently, advantages of certain embodiments of the present disclosure enable significant cost reduction over the life of rotating equipment compared to conventional bearing assemblies.

To facilitate a better understanding of the present disclosure, the following examples of certain embodiments are given. In no way should the following examples be read to limit, or define, the scope of the invention.

For convenience of reference, when referring to components in longitudinal relation to one another on the drill string, the term "lower" refers to components closer or proximate to the drill bit whereas "upper" refers to components away from or distal from the drill bit.

FIG. 1 illustrates drilling assembly 10 including motor 12 and transmission 14 that are operatively coupled to threaded upper end 16 of shock sub 18. Drill bit 60 is operatively coupled to lower end 17 of shock sub 18. In one embodiment, drill bit 60 is a PDC drill bit.

Figure 2:
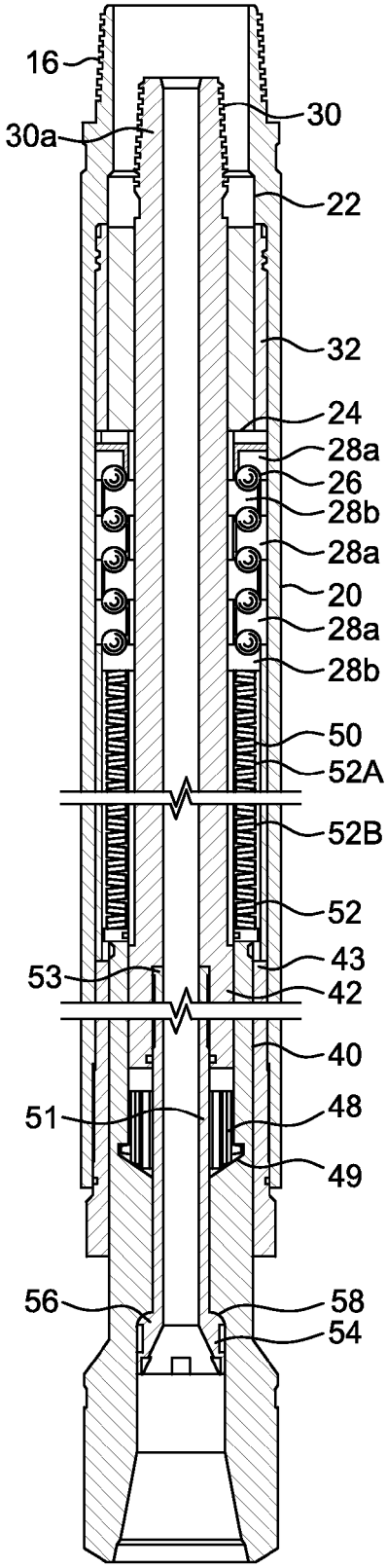
FIG. 2 illustrates a partial cross-sectional view of a drilling assembly.
Figure 3:
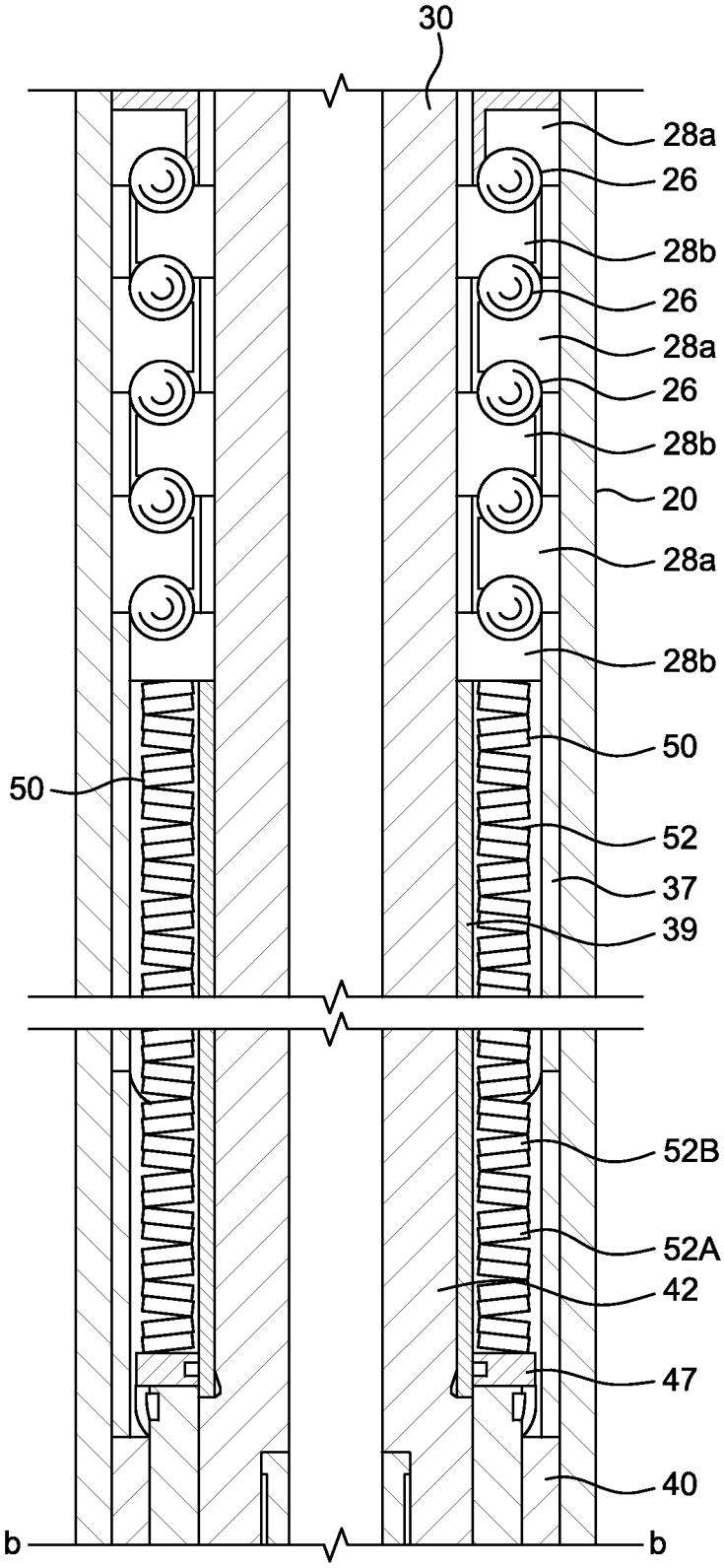
FIG. 3 illustrates a magnified view of an upper portion of the partial cross sectional view of FIG. 2.
Figure 4:
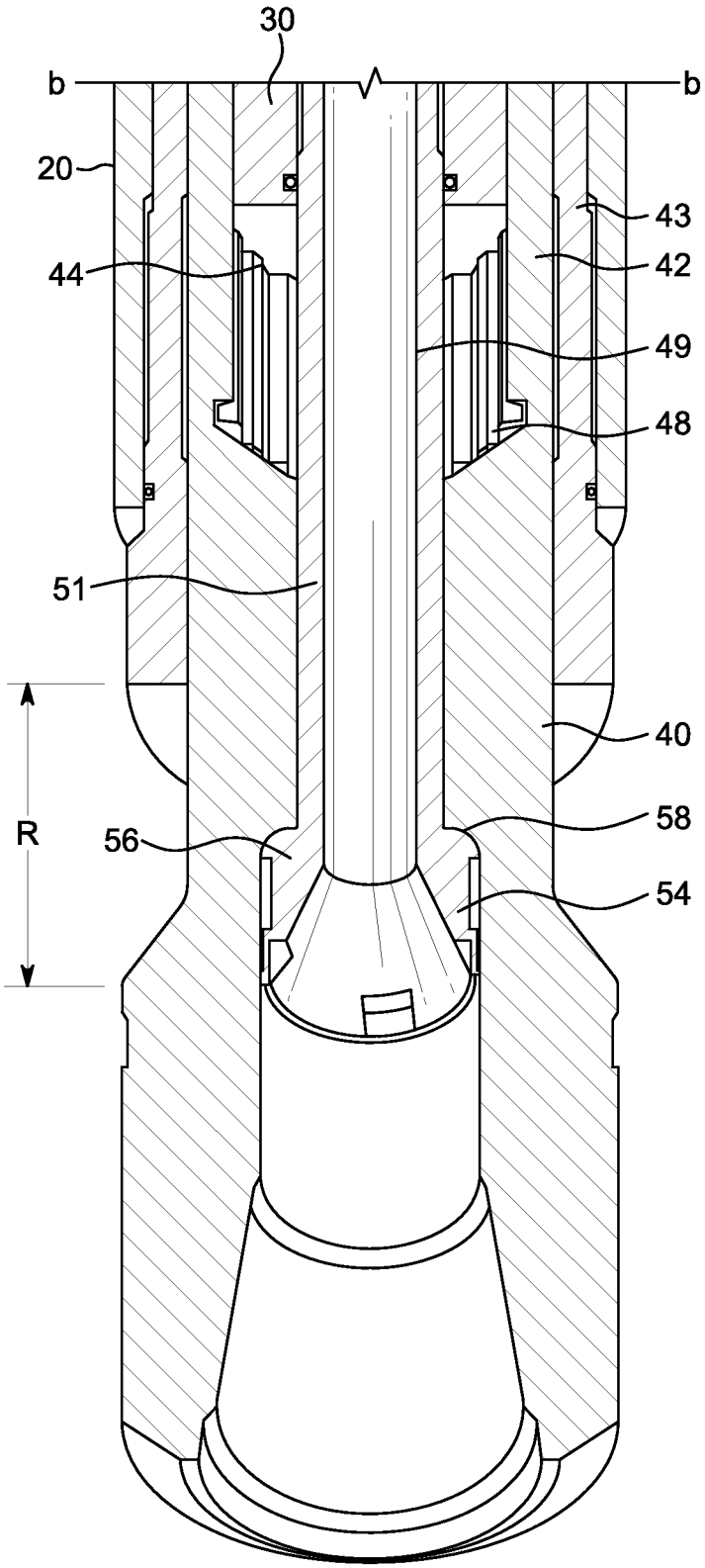
FIG. 4 illustrates a magnified view of a lower portion of the partial cross-sectional view of FIG. 2.

With continuing reference to FIGS. 2, 3, and 4, shock sub 18 includes housing 20 that is adapted to receive rotatable shaft assembly 22 and thrust stack 24. Thrust stack 24 includes ball bearings 26 that are disposed between stationery races 28*a* and rotating races 28*b*. Each pair stationery and rotating races 28*a*, 28*b* are capable of operating under up to approximately 15,000 lb force. Rotatable shaft assembly 22 includes upper shaft 30 having upper end 30*a* that is supported by first radial bearing 32 as would be understood by those of skill in the art. Lower shaft 40 is disposed around and extends downwardly from lower end 42 of upper shaft 30. Lower shaft 40 is supported by second radial bearing 43. Upper mating splines 44 are disposed around an outer surface of upper shaft 30. Upper mating splines 44 operatively mate with corresponding lower mating splines 48 that are disposed on inner surface 49 of lower shaft 40. Lower shaft 40 is adapted to telescopically extend from upper shaft 30.

Lower mandrel stop 51 extending between first end 53 and bottom end 54 extends from lower end 42 of upper shaft 30. In one embodiment, lower mandrel stop is integral with upper shaft 30. In yet another embodiment, first end 53 of lower mandrel stop 51 may be threadably attached to lower end 42 upper out put shaft. Those of ordinary skill in the art will appreciate other methods that may be utilized to couple the first end 53 to lower end 42. A ledge 56 extends outwardly around the bottom end 54.

Shoulder 58 is machined on lower shaft 40. Shoulder 58 is adapted to engage ledge 56 of lower mandrel stop 51 when lower shaft 40 is in the fully extended position as shown in (FIG. 4). Consequently the lower shaft 40 can be retracted along upper shaft 30 when an opposing axial force from the formation is transmitted to the lower shaft 40 by drill bit 60, thereby allowing lower shaft to travel axially over a distance R.

Biasing mechanism 50 is disposed within housing 20 as shown in FIGS. 2 and 3. Stationery spacer 37 is disposed between biasing mechanism 50 and housing 20. Upper shaft 30 extends through biasing mechanism 50 and rotating spacer 39 is disposed between upper shaft 30 and rotating spacer 39. Stationery spacer 37 and rotating spacer 39 are provided to enable biasing mechanism 50 to be preloaded and torqued and also to serve as a protective surface to prevent biasing mechanism 50 from rubbing against housing 20 and/or upper shaft 30. Arm 47 extends outwardly from rotating spacer 39 and supports a bottom end of biasing mechanism 50. In one embodiment, biasing mechanism 50 comprises a plurality of disc springs 52 manufactured by Bellevile Springs of Redditch, United Kingdom. Springs 52 are arranged in series configuration to bias lower shaft 40 in an extended position with respect to upper shaft 30. In certain embodiments, biasing mechanism 50 comprises springs 52 having varying spring constants. For example, spring 52A has a first spring constant that is different form a second spring constant of spring 52B. In another embodiment of the present disclosure, the biasing mechanism may be a coil spring or a wave spring as will be understood by those of ordinary skill in the art. In some embodiments, a dynamic fluid may be utilized as the biasing mechanism.

In operation, when motor 12 is operated to rotate upper shaft 30, upper mating splines 44 and lower mating splines 48 engage and cause lower shaft 40 to rotate thereby transmitting rotational energy to drill bit 60. As will be understood by those of skill in the art, drill bit 60 experiences opposing axial forces from the formation during drilling operations. These axial forces are transmitted directly to lower shaft 40. Hitherto, the axial forces will be transmitted from lower shaft 40 to other components of the drill string including sensitive instrumentation components that may be damaged by such forces. Also severe axial forces may reduce the rate of penetration of drill bit 60 due to "bit bounce" as discussed above.

However, in drilling assembly 10 disclosed herein, the axial forces are transmitted from lower shaft 40 to biasing mechanism 50 which aids in preventing or minimizing bit bounce, thereby increasing the rate of penetration of drill bit 60. The biasing mechanism also dampens vibrations and absorbs axial shocks preventing such vibrations and/or axial shocks from impacting other components of the drill string and motor 12 because the biasing mechanism is disposed between the drill bit and motor 12. Therefore, biasing mechanism 50 is able to absorb/dissipate vibrations and/or axial shocks before motor 12 and/or other components experience the vibrations and/or shocks. Further, biasing mechanism 50 engages thrust stack 24 when lower shaft 40 transmits axial forces to biasing mechanism 50 to further dissipate axial forces without compromising the integrity of other components installed in the drill string. It is contemplated that the ability of drilling assembly 10 to dampen vibrations and absorb axial shocks can be varied by varying the spring coefficients of springs 52.

Consequently, it is contemplated that the configuration of biasing mechanism 50 and/or thrust stack 24 disposed downstream of motor 12 helps to increase the serviceable life of drill string components. This configuration allows for a more compact drilling assembly 10. In addition, this configuration of components downstream of motor 12 enables vibration dampening and shock absorption closer to drill bit 60 thereby allowing a greater percentage of vibrations and shocks to be dissipated away from components of the downhole assembly.

It is believed that incorporation of the above-described assembly 10 in a drill string reduces bit bounce and enables absorption and/or dissipation of axial shocks and/or vibrations experienced by a drill bit and prevent such axial shocks and/or vibrations from damaging components of the drill sting and the motor that drives the drill string. In addition, incorporation of the assembly 10 results in a compact and more efficient drill sting.

It is explicitly recognized that any of the elements and features of each of the devices described herein are capable of use with any of the other devices described herein with no limitation. Furthermore, it is explicitly recognized that the steps of the methods herein may be performed in any order except unless explicitly stated otherwise or inherently required otherwise by the particular method.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined herein.

What is claimed is:

1. A shock absorber assembly comprising:

a housing;

a biasing mechanism disposed within the housing;

a rotatable shaft assembly comprising:

a thrust bearing assembly;

an upper shaft supported by a first radial bearing, wherein the upper shaft is capable of being attached to a motor;

a lower shaft supported by a second radial bearing is concentrically disposed around at least a portion of the upper shaft, wherein the lower shaft is telescopically extendable from the upper shaft, the lower shaft is capable of being attached to a drill bit, and the second radial bearing is located outside of the lower shaft and inside of the housing;

a mating mechanism that rotationally fixes rotation of the lower shaft with respect to the upper shaft; and wherein axial shocks are transmitted from the drill bit to the rotatable shaft assembly and the rotatable shaft assembly limits such axial shocks from being transmitted to the motor.

2. The shock absorber assembly of claim 1, wherein the lower shaft abuts the biasing mechanism.

3. The shock absorber assembly of claim 2, wherein the biasing mechanism biases the lower shaft in an extended position.

4. The shock absorber assembly of claim 2, wherein the biasing mechanism comprises a spring assembly.

5. The shock absorber of claim 2, wherein the biasing mechanism includes a plurality of disc springs.

6. The shock absorber of claim 2, further including a thrust bearing assembly disposed adjacent a top portion of the biasing mechanism.

7. The shock absorber of claim 6, wherein the thrust bearing assembly comprises a ball bearing disposed between two races.

8. The shock absorber of claim 7, wherein the thrust bearing assembly comprises a plurality of ball bearings disposed between a plurality of alternating races.

9. The shock absorber of claim 2, wherein the mating mechanism comprises mating splines disposed on an outer surface of the upper shaft and on an inner surface of the lower shaft.

10. The shock absorber of claim 2, wherein corresponding mating splines are adapted to engage in an operative state.

11. The shock absorber of claim 2, wherein a travel distance of the lower shaft is limited by a catch that is machined on an internal surface of the lower shaft.

12. A method of dampening axial shock on a drill bit comprising the steps of:

providing a shock absorber between a motor and the drill bit, the shock absorber comprising:

a housing;

providing a biasing mechanism disposed within the housing;

providing a rotatable shaft assembly comprising:

an upper shaft supported by a first radial bearing, a lower shaft supported by a second radial bearing and concentrically disposed around at least a portion of the upper shaft, wherein the lower shaft is telescopically extendable from the upper shaft, and the second radial bearing is located outside of the lower shaft and inside of the housing;

providing a thrust bearing assembly disposed adjacent the biasing mechanism;

providing a mating mechanism that rotationally fixes rotation of the lower shaft with respect to the upper shaft; and providing a drill bit that is coupled to a the lower shaft.

13. The method of claim 12, wherein the upper shaft and the lower shaft are operatively coupled by mating splines disposed on an outer surface of the upper shaft and on an inner surface of the lower shaft.

14. The method of claim 13, wherein a biasing mechanism biases the lower shaft in an extended position relative to the upper shaft.

15. The method of claim 14, wherein the extent of travel of the lower shaft is limited by a catch machined on an internal surface of the lower shaft.

16. The method of claim 12, wherein the drill bit transmits an axial loading to the biasing mechanism.

17. The method of claim 16, wherein the biasing mechanism transmits axial loading to the thrust bearing assembly.

18. The method of claim 17, wherein the biasing mechanism comprises a biasing mechanism that is a coil spring or a wave spring.

19. A shock absorber for dampening axial drill string vibration and shock comprising:

an upper end of the shock absorber capable of being operably connected to a motor located above the shock absorber in a drill string, a lower end of the shock absorber capable of being operably connected to a drill bit located below the shock absorber in the drill string, and a housing located between and operably connected to the upper shock absorber end and the lower shock absorber end;

an upper shaft located within an upper portion of the housing, an upper end of the upper shaft capable of being operably connected to the motor and lower end of the upper shaft having a first set of mating splines disposed thereon;

a first radial bearing located within the upper portion of the housing;

a thrust bearing assembly located between the upper shaft and the housing comprising a plurality of bearings and a plurality of races;

wherein the upper shaft extends through and is supported by the first radial bearing;

a lower shaft located within the housing, a lower end of the lower shaft capable of being operably connected to the drill bit wherein the lower shaft has a second set of mating splines disposed thereon;

a second radial bearing located within the housing;

wherein the lower shaft extends through and is supported by the second radial bearing;

wherein the first set of mating splines and the second set of mating splines are sized, shaped, and positioned to slidably mate with each other, the first set of mating splines and the second set of mating splines capable of axially sliding between each other; the combination of the first set of mating splines and the second set of mating splines, when mated, being capable of transmitting rotational motion from the upper shaft to the lower shaft and the lower shaft being telescopically extendable and retractable relative to the upper-shaft;

a mandrel operably connected to the upper shaft having a ledge extending from a lower portion of the mandrel;

a shoulder on an internal surface of the lower shaft;

wherein the ledge and the shoulder overlap within the lower shaft to limit telescopic extension of the lower shaft from the upper shaft;

a biasing mechanism located within the housing wherein the biasing mechanism biases the lower shaft toward an extended position with respect to the upper shaft and is capable of dampening vibration and shock from the lower shaft to the upper shaft, wherein the biasing mechanism comprises a series of disc springs;

wherein the shock absorber is capable of dampening axial vibration and shock during downhole drilling to reduce bit bounce by the drill bit and is capable of dampening vibration and shock transmitted from the drill bit to the motor during downhole drilling relative to a similar drill string, motor, and drill bit combination without the shock absorber.

20. A shock absorber assembly comprising:

a housing;

a biasing mechanism within the housing;

a rotatable shaft assembly within the housing comprising:

a thrust bearing assembly;

an upper shaft supported by a first radial bearing, wherein the upper shaft is capable of being attached to a motor;

a lower shaft supported by a second radial bearing is concentrically disposed around at least a portion of the upper shaft, wherein the lower shaft is telescopically extendable from the upper shaft and the housing, the lower shaft is rotatable within the housing, and the lower shaft is capable of being attached to a drill bit;

a mating mechanism that rotationally fixes rotation of the lower shaft with respect to the upper shaft;

a mandrel operably connected to the upper shaft having a ledge extending from a lower portion of the mandrel;

a shoulder on an internal surface of the lower shaft;

wherein the ledge and the shoulder overlap within the lower shaft to limit telescopic extension of the lower shaft from the upper shaft; and wherein the shock absorber is capable of dampening axial shocks from the drill bit to the motor.

21. A shock absorber for dampening axial shock comprising:

an upper end of the shock absorber capable of being operably connected to a motor located above the shock absorber in a drill string, a lower end of the shock absorber capable of being operably connected to a drill bit located below the shock absorber in the drill string, and a housing located between and operably connected to the upper shock absorber end and the lower shock absorber end;

an upper shaft located within an upper portion of the housing, an upper end of the upper shaft capable of being operably connected to the motor and lower end of the upper shaft having a first set of mating splines disposed thereon;

a first radial bearing located within the upper portion of the housing;

a thrust bearing assembly located between the upper shaft and the housing comprising a plurality of bearings and a plurality of races;

wherein the upper shaft extends through and is supported by the first radial bearing;

a lower shaft located within the housing, a lower end of the lower shaft capable of being operably connected to the drill bit wherein the lower shaft has a second set of mating splines disposed thereon;

a second radial bearing located outside of the lower shaft and within the housing;

wherein the lower shaft extends through and is supported by the second radial bearing;

wherein the first set of mating splines and the second set of mating splines are sized, shaped, and positioned to slidably mate with each other, the first set of mating splines and the second set of mating splines capable of axially sliding between each other; the combination of the first set of mating splines and the second set of mating splines, when mated, being capable of transmitting rotational motion from the upper shaft to the lower shaft, and the lower shaft being telescopically extendable and retractable relative to the upper-shaft; and a biasing mechanism located within the housing wherein the biasing mechanism biases the lower shaft toward an extended position with respect to the upper shaft and is capable of dampening shock from the lower shaft to the upper shaft.

* * * * *